United States Patent [19]

Emanuel

[11] Patent Number: 4,816,004

[45] Date of Patent: Mar. 28, 1989

[54] MEANS FOR PROVIDING UPLIFT TO THE FEMALE BUST

[75] Inventor: Elizabeth Emanuel, London, England

[73] Assignee: Emanuel Designs Limited, London, England

[21] Appl. No.: 942,351

[22] Filed: Dec. 16, 1986

[30] Foreign Application Priority Data

Dec. 18, 1985 [GB] United Kingdom ..... 8531142

[51] Int. Cl.[4] ..... A41C 3/10

[52] U.S. Cl. ..... 450/55; 450/56; 450/57

[58] Field of Search ..... 128/480, 481; 450/55, 450/56, 57

[56] References Cited

U.S. PATENT DOCUMENTS

| | | | |
|---|---|---|---|
| 2,041,066 | 5/1936 | Howard | 128/480 |
| 2,427,851 | 9/1947 | Gerst | 128/481 |
| 2,429,308 | 10/1947 | Cooper | 128/481 |
| 2,515,601 | 7/1950 | Hughes | 128/480 |
| 4,572,195 | 2/1986 | Hyams | 128/481 |

*Primary Examiner*—Werner H. Schroeder
*Assistant Examiner*—Jeanette E. Chapman
*Attorney, Agent, or Firm*—Silverman, Cass, Singer & Winburn, Ltd.

[57] ABSTRACT

Means for providing uplift to the female bust comprises a pad to be used in conjunction with another like pad, each pad being placed, in use, in the lower part of a respective cup of a brassiere, the pad being defined by a first substantially flat surface, D-shaped in outline, a second substantially flat surface, also D-shaped in outline, and a third convex surface, the first and second surfaces meeting substantially at right angles along the straight edges of the D's and the convex surface being bounded by the curved edges of the D's.

18 Claims, 2 Drawing Sheets

MEANS FOR PROVIDING UPLIFT TO THE FEMALE BUST

This invention relates to means for providing uplift to the female bust.

Some measure of uplift to the female bust is provided by a brassiere but it is by no means a simple matter to design a brassiere which provides a high degree of uplift.

It is an object of the invention to provide a simple yet effective means for providing uplift to the female bust.

The present invention provides means for providing uplift to the female bust comprising a pad to be used in conjunction with another like pad, each pad being placed, in use, in the lower part of a respective cup of a brassiere, the pad being defined by a first substantially flat surface, D-shaped in outline, a second substantially flat surface, also D-shaped in outline, and a third convex surface, the first and second surfaces meeting substantially at right angles along the straight edges of the D's and the convex surface being bounded by the curved edges of the D's.

Surprisingly, such pads give an attractive uplift to the female bust in spite of the fact that the use of two substantially-flat surfaces would hardly be expected to suit the rounded contours of the female body.

Preferably, the pad comprises stuffing material within an outer fabric casing. Such a construction allows loose material such as kapok or tiny scraps of foamed plastics material to be employed.

Advantageously, the stuffing material is a block of resilient foamed plastics material. Such a construction has the advantage that the block can be shaped and yet is resiliently compressible.

Advantageously, the depth of one D-shaped surface is substantially greater than the depth of the other D-shaped surface. That feature enables the pad to be suited to the size of the user by choosing the orientation in which it is used.

Preferably, the pad comprises stuffing material within first and second casings, the first casing being of a coarse fabric and the second casing being outermost and of a decorative fabric The second casing may, for example, be of silk or lace.

Preferably, the straight edges of the D-shaped surfaces are between 10 and 14 centimeters long, more preferably between 11 and 13 centimeters, and yet more preferably approximately 12 centimeters long.

Preferably, one D-shaped surface is between 5 and 8 centimeters deep, more preferably between 6 and 7 centimeters, and yet more preferably approximately 6.5 centimeters deep.

Preferably, one D-shaped surface is between 4 and 6 centimeters deep, more preferably between 4.5 and 5.5 centimeters, and yet more preferably approximately 5 centimeters deep.

The invention also embraces use of means according to the invention for providing uplift to the female bust.

Means, constructed in accordance with the invention, for providing uplift to the female bust will now be described by way of example only with reference to the accompanying drawings, in which.

Figure 1:
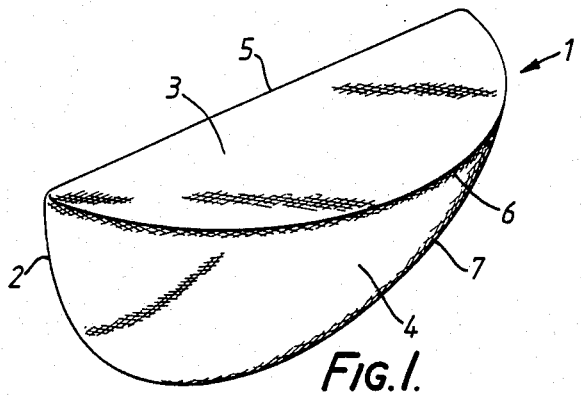
FIG. 1 is a perspective view of the means.
Figure 2:
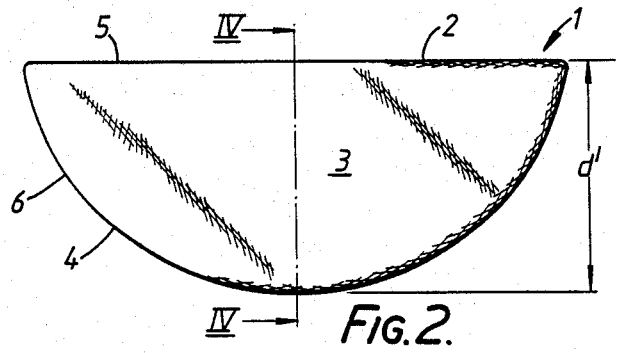
FIG. 2 is a plan view of the means.
Figure 3:
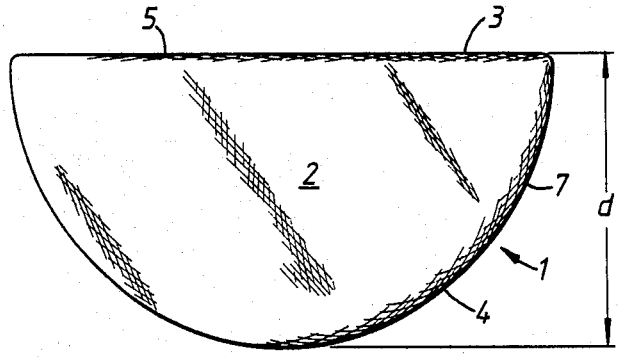
FIG. 3 is an elevational view of the means.
Figure 4:
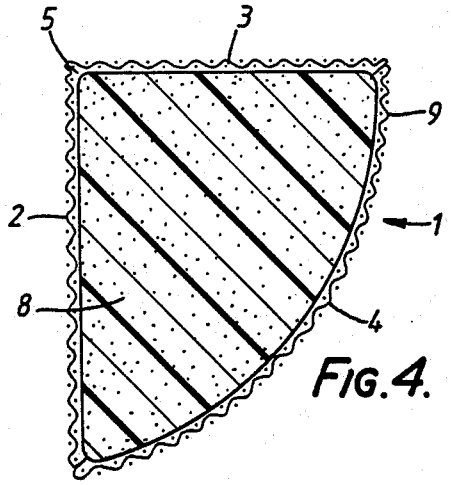
FIG. 4 shows the cross-sectional shape of the means on the line IV—IV marked in FIG. 2.
Figure 5:
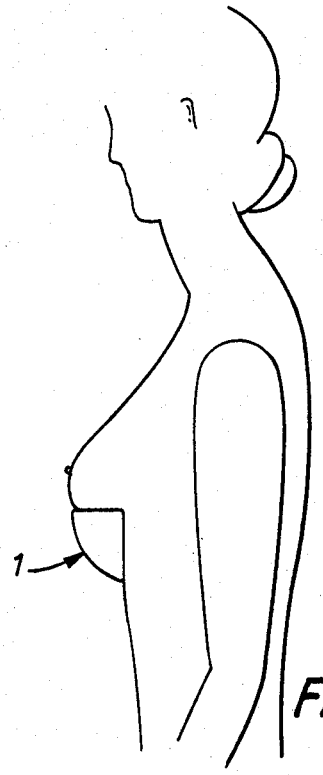
FIG. 5 is a diagrammatic view showing the use of the means.

Referring to the drawings, a means 1 for providing uplift to the female bust comprises a pad defined by a first substantially flat surface 2, D-shaped in outline, a second substantially flat surface 3, also D-shaped in outline, and a third convex surface 4. The first surface 2 meets the second surface 3 substantially at right angles along the line 5 corresponding to the straight edges of the D's. The convex surface 4 is bounded by the curved edges 6 and 7 of the D's.

The pad comprises a shaped block of resilient foamed plastics material 8 within a calico casing 9. The calico casing 9 is made up of three panels sewn together, the panels corresponding to the first, second and third surfaces 2, 3 and 4. An outer casing (not shown) is also provided and made of a decorative fabric, for example, printed silk or lace.

The straight edges, line 5, of the D-shaped surfaces 2 and 3 are approximately 12 centimeters long. The D-shaped surface 2 has a depth d of approximately 6.5 centimeters whereas the D-shaped surface 3 has a depth d' of approximately 5 centimeters.

The pad just described is used with another like pad by placing each pad within a respective cup of a brassiere. Each pad is placed in the lower part of the cup so that one of the substantially flat surfaces 2, 3 faces the underside of the breast of the wearer and the other flat surface faces the chest beneath the breast. The pads provide uplift of the bust and an "instant cleavage".

It is also possible to use the pads inside a tight bodice instead of using a brassiere.

The outside of the pads may be decorated in any desired way, for example, by means of bows.

I claim:

1. Means for providing uplift to the female bust comprising a pad to be used in conjunction with another like pad, the pad being defined by a first substantially flat surface, D-shaped in outline, a second substantially flat surface, also D-shaped in outline, and a third convex surface, the first and second surfaces meeting substantially at right angles along the straight edges of the D's and the convex surface being bounded by the curved edges of the D's, each pad being adapted to be placed with a first of said flat surfaces against the bottom of the breast and the second one of said flat surfaces against the body beneath the breast.

2. Means as claimed in claim 1, wherein the pad comprises stuffing material within an outer fabric casing.

3. Means as claimed in claim 2, wherein the stuffing material is a loose material such as kapok or tiny scraps of foamed plastics material.

4. Means as claimed in claim 2, wherein the stuffing material is a block of resilient foamed plastics material.

5. Means as claimed in claim 1, wherein the depth of one D-shaped surface is substantially greater than the depth of the other D-shaped surface.

6. Means as claimed in claim 1, wherein the pad comprises stuffing material within first and second casings, the first casing being of a coarse fabric and the second casing being outermost and of a decorative fabric.

7. Means as claimed in claim 1, wherein the straight edges of the D-shaped surfaces are between 10 and 14 centimeters long.

8. Means as claimed in claim 1, wherein the straight edges of the D-shaped surfaces are between 11 and 13 centimeters long.

9. Means as claimed in claim 1, wherein the straight edges of the D-shaped surfaces are approximately 12 centimeters long.

10. Means as claimed in claim 1, wherein one D-shaped surface is between 5 and 8 centimeters deep.

11. Means as claimed in claim 1, wherein one D-shaped surface is between 6 and 7 centimeters deep.

12. Means as claimed in claim 1, wherein one D-shaped surface is approximately 6.5 centimeters deep.

13. Means as claimed in claim 1, wherein one D-shaped surface is between 4 and 6 centimeters deep.

14. Means as claimed claim 1, wherein one D-shaped surface is between 4.5 and 6.5 centimeters deep.

15. Means as claimed in claim 1, wherein one D-shaped surface is approximately 5 centimeters deep.

16. Means for providing uplift to the female bust comprising a pad to be used in conjunction with another like pad, each pad comprising stuffing material within first and second casings, the second casing being outermost and of a decorative fabric, the pad being defined by a first substantially flat surface, between 5 to 8 centimeters deep and D-shaped in outline, a second substantially flat surface, between 4 and 6 centimeters deep and D-shaped in outline, and a third convex surface, the first and second surfaces meeting substantially at right angles along the straight edges of the D's, the straight edges of the D-shaped surfaces being between 10 and 14 centimeters long, and the convex surface being bounded by the curved edges of the D's, each pad adapted to be placed with a first of said flat surfaces against the bottom of the breast and the second one of said flat surfaces against the body beneath the breast.

17. Means as claimed in claim 16, wherein the stuffing material is a loose material such as kapok or scraps of foamed plastics material.

18. Means as claimed in claim 16, wherein the stuffing material is a block of resilient foamed plastics material.

* * * * *